US005304450A

United States Patent [19]

Paine

[11] Patent Number: 5,304,450

[45] Date of Patent: Apr. 19, 1994

[54] PROCESSES FOR THE PREPARATION OF TONER COMPOSITIONS

[75] Inventor: Anthony J. Paine, Mississauga, Canada

[73] Assignee: Xerox Corporation, Stamford, Conn.

[21] Appl. No.: 738,413

[22] Filed: Jul. 31, 1991

Related U.S. Application Data

[62] Division of Ser. No. 386,386, Jul. 28, 1989, abandoned.

[51] Int. Cl.[5] ..... G03G 9/083
[52] U.S. Cl. ..... 430/137; 524/923
[58] Field of Search ..... 430/137; 524/923

[56] References Cited

U.S. PATENT DOCUMENTS 3,717,605 2/1973 Osmond et al. ..... 524/533
5,108,863 4/1992 Hsieh et al. ..... 430/137

FOREIGN PATENT DOCUMENTS 1143404 2/1969 United Kingdom ..... 524/923

*Primary Examiner*—John Goodrow
*Attorney, Agent, or Firm*—E. O. Palazzo

[57] ABSTRACT

A process for the preparation of polymer particles which comprises dissolving a polymer in a solvent containing a block or graft steric stabilizer, and adding thereto a nonsolvent for the polymer, which nonsolvent functions as a solvent for the stabilizer chains of the block or graft steric stabilizer.

14 Claims, No Drawings

PROCESSES FOR THE PREPARATION OF TONER COMPOSITIONS

This is a division of application Ser. No. 386,386, filed Jul. 28, 1989 now abandoned.

BACKGROUND OF THE INVENTION

This invention is generally directed to processes for the preparation of polymer particles, and to processes for the preparation of toner compositions, including dry and liquid toners. More specifically, the present invention is directed to the preparation of particles, including toner particles by, for example, dissolving a polymer in a solvent containing a block or graft steric stabilizer, and adding to the resulting mixture a liquid, or nonsolvent within which the polymer is insoluble or substantially insoluble. In one embodiment of the present invention, a polymer is dissolved in a solvent together with a stabilizer, such as a block copolymer, a triblock copolymer, a graft copolymer, or mixtures thereof followed by the addition of a nonsolvent for the polymer permitting the precipitation of the polymer product into particles suitable in some instances for imaging processes. One embodiment of the present invention comprises the precipitation of a polymer, including a homopolymer, or a copolymer A from a solution containing a suitable sterically stabilizing block or graft copolymer with A (or A-compatible) segments bonded chemically to B segments by the addition of a nonsolvent for A which is also a solvent for B, thereby providing a sterically stabilized dispersion of polymer particles, which polymers can be isolated by, for example, filtration or centrifugation. The aforementioned product particles can be formulated into toners by adding thereto pigments, dyes, colorants, or mixtures thereof. Also, liquid developers can be formulated from the product dispersion obtained with the process of the present invention. Moreover, the polymer particles of the present invention may be selected for formulating paints and chromatographic components.

Polymer or copolymer A can, for example, be a resin selected for superior charging or fusing properties in xerographic imaging and printing applications. Examples of the aforementioned polymer resins include homopolymers such as polyesters, poly(*n*-butyl methacrylate), poly(2-ethylhexyl methacrylate), poly(*n*-lauryl methacrylate), poly(stearyl methacrylate), poly(eicosane), and the like, and copolymers of the above with each other or with styrene or butadiene as, for example, poly(styrene-co-butyl methacrylate), poly(styrene-co-butadiene), and the like.

Polymer or copolymer segments B are selected for compatibility with the nonsolvent to achieve steric stabilization. For hydrocarbon nonsolvents, such as heptane, isooctane and Isopar mixtures available from Exxon, for example, B can include homopolymers such as polyethylene, poly(butadiene), hydrogenated poly(-butadiene), poly(isoprene), and the like, or copolymers such as poly(ethylene-co-propylene). For polar nonsolvents such as methanol or ethanol, for example, B can include homopolymers such as hydroxypropyl cellulose, poly(N-vinylpyrrolidone), poly(vinylbutyral), poly(ethylene oxide), and the like, or other alcoholic soluble copolymers.

With further respect to the aforesaid A and B segments, the block stabilizer can be of the type AB, ABA, BAB, or the like, while the grafted stabilizer contains B side chains grafted onto A chains, or A side chains grafted onto B chains. These block or graft copolymers include commercially available materials such as Solprenes available from Phillips Inc., Kratons available from Shell Chemical Company, or Pluronics and Tetronics available from BASF, including dispersion polymerized particles, where the formation of 0.1 percent to 10 percent graft occurs during polymerization. For example, styrene polymerized in ethanol in the presence of hydroxypropyl cellulose, or poly(N-vinylpyrrolidone) generates about two percent of polystyrene grafted onto hydroxypropyl cellulose or poly(N-vinylpyrrolidone).

The precipitation of polymers is known for the isolation and purification of polymers, however, these processes usually provide undesirable large flocs or gummy materials usually unsuitable for toners or liquid inks. In contrast, with the processes of the present invention there are selected, for example, sterically stabilizing block or graft copolymers, enabling the formation of stable latex particles and avoiding the aforementioned prior art disadvantage.

More specifically, many process are known for the preparation of polymer particles for xerographic dry and liquid toners. Prior art processes for the preparation of toner size particles can generally be classified into two main areas: the mechanical melt blending, extrusion and jetting or micronization process, and the (2) chemical processes such as emulsion polymerization, suspension polymerization and dispersion polymerization which form particles directly from monomers.

The mechanical melt blending, extrusion and jetting process have several disadvantages which are overcome by the process of the present invention. Melt blending of particles in, for example, Banbury mixers, followed by extrusion in large commercial extruders is a semicontinuous process where the changeover from manufacture of one color of toner to another color involves the substantial waste of resin material needed to clean flush the blenders, extruders and jetting mill. In contrast, with the processes of the present invention the manufacture of a number of small batches of different toners, for example, for custom color or testing purposes without waste, or wherein waste of resin is minimized can be achieved. Also, there is a need for lower fusing temperature toners to extend fuser roll lifetime and reliability while decreasing energy costs. However, many lower melting resins cannot be jetted successfully, precluding their application for this need. The process of the present invention does not require jetting to prepare particles and therefore is believed to be better suited for lower melting resins. Further, the prior art multistep process of melt blending, extrusion and jetting consumes substantial time and is energy intensive. Also, with many of the prior art processes particles smaller than about 9 to 10 microns cannot be obtained without substantially greater processing time, classification and recycling steps. There is thus a need for economical processes, and processes wherein less energy is consumed that permit high resolution xerographic toners of from about 5 to 10 microns in average particle diameter, and preferably about 7 microns enabling, for example, improved copy quality of colored images. Melt blending, extrusion and jetting is not able in most instances to address this need economically.

To address the disadvantages of mechanical toner preparation via melt blending, extrusion and micronization or jetting, several chemical processes have been disclosed in the prior art, including emulsion polymerization, suspension polymerization, and dispersion polymerization. While these processes are useful for their intended purposes, they also have several disadvantages for the preparation of xerographic toners and inks.

Emulsion polymerization usually produces particles with average diameters of less than 1 micron. While this size is very satisfactory for liquid developers, it is too small for dry toners, where particles of 3 to 15 microns, and preferably 5 to 10 microns in average diameter are usually desired. The process of the present invention enables the preparation of polymer particles of an average diameter of from about 0.1 to 200 microns, thus it is more suitable for dry toner preparation than is emulsion polymerization.

Suspension polymerization is a very useful process for the preparation of toner resins to be used for the mechanical melt blending, extrusion and jetting process of toner particle manufacture. Unfortunately, the suspension polymerized particle size of 100 to 2,000 microns is too large to be suitable for direct use as either dry or liquid toners, thus there is a need for a process to convert the resin obtained from suspension polymerization into particles of 0.1 to 3 microns for liquid developers and 3 to 15 microns for dry toners. The process of the present invention satisfies these needs.

Dispersion polymerization is a useful process for the preparation of liquid or dry toner particles in the 0.1 to 15 average diameter micron range. However, the resin molecular weight and molecular weight distribution correlate strongly with particle size; the smaller particles have very much higher molecular weights. Therefore, it is difficult to prepare toner particles which possess both the desired particle size and the desired resin properties such as glass transition temperature, melting temperature, molecular weight,and molecular weight distribution. Furthermore, copolymerization dispersion processes are more difficult than homopolymerization, and have additional problems such as lower yield, multimodal size distributions, incomplete conversion, and the like. The process of the present invention avoids these problems associated with dispersion polymerization since the process of the present invention employs a preformed polymer in some embodiments. Thus it is possible to optimize the polymer properties separately from the particle size with the processes of the present invention in some embodiments For example, the present invention permits one to change the particle size of a dispersion polymerized particle to one more suitable for its application.

As a result of a patentability search there were located U.S. Pat. Nos. 3,257,341; 3,717,605; 3,876,610; 3,893,933 and 4,102,846. The '341 and '605 patents illustrate the process of polymerizing a monomer A in a solvent in the presence of a block or graft copolymer of monomers A and B. The polymer of A is not soluble in the reaction solvent, however, the polymer of B is soluble according to the teachings of this patent. Also the copolymer AB stabilizes the polymer A particles. Also, in column 1, lines 33 to 43, of the '341 patent the process is referred to as coprecipitation of polymer A and copolymer AB. However, the process described in these patents is known as dispersion polymerization, and involves the polymerization of monomers into polymer A. The process of the present invention does not involve any polymerization step. Thus, the dispersion polymerized particle products of the aforementioned patents may be selected as raw materials (polymer A and stabilizer AB) for the process of the present invention, enabling some of the advantages of the present invention as indicated herein. Since the products of the reactions cited in the preceding patents are dispersion polymerized particles, they contain grafted materials therein. However, an advantage of the processes of the present invention is that these dispersion polymerized particles of the prior art, which are in the 0.1 to 3 microns size range, can be dissolved and precipitated into larger particles with a diameter of form about 0.1 to 200 microns.

Furthermore, other references of background interest are U.S. Pat. Nos. 3,165,420; 3,236,776; 4,145,300; 4,271,249; 4,556,624; 4,557,991 and 4,604,338.

The process of the present invention provides advantages not usually available with mechanical melt blending, extrusion and micronization or jetting process, or from emulsion polymerization, suspension polymerization or dispersion polymerization particle formation reactions. In addition, the precipitation process of the present invention can be applied to preparation of both ink sized and toner sized particles, while many of the prior art processes are limited to one or the other.

The particles obtained with the processes of the present invention can be selected for toner compositions, including magnetic, single component, two component, liquid toners, and colored toner compositions. There are also provided in accordance with the present invention positively or negatively charged toner compositions comprised of the polymers obtained by the processes illustrated herein, pigment particles or dyes, and optional additive components such as metal salts of fatty acids, colloidal silicas, and charge enhancing additives. The toner, and developer compositions illustrated herein are useful in electrophotographic imaging systems, especially xerographic imaging methods. In addition, developer compositions comprised of the aforementioned toners and carrier particles can be formulated.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions having incorporated therein as charge enhancing additives, organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014 and 4,394,430.

SUMMARY OF THE INVENTION

It is an object of the present invention to provide processes for the preparation of polymer particles with many of the advantages illustrated herein.

Another object of the present invention is to provide economical processes for the preparation of polymer particles wherein polymerization of monomers during particle formation is avoided.

A further object of the present invention is to provide processes for the preparation of polymer particles from resins which cannot usually be jetted.

An additional object of the present invention is to provide processes for the conversion of particles formed by emulsion polymerization, suspension polymerization, or dispersion polymerization into particles of any desired average size including between about 0.1 microns and 200 microns, and preferably between about 0.1 microns and 15 microns.

Also, in another object of the present invention there are provided economical processes for the preparation of toner compositions comprised of polymer particles and pigment, or dye particles.

Another object of the present invention is to provide processes for the preparation of small, for example 1 gram to 1 kilogram, or large, for example 10 kilogram to 10,000 kilogram, batches of colored toner particles suitable for custom color toners, or for testing purposes while avoiding the waste of resin needed for flushing equipment between batches as is usually the situation with the prior art semicontinuous melt blending, extrusion and jetting process.

Yet another object of the present invention is to provide processes which permit the independent control of bulk properties such as glass transition temperature, melting temperature, molecular weight and the like, and of surface properties such as triboelectric charge, humidity sensitivity, flow, and the like for the resulting products.

In another object of the present invention there are provided styrene butadiene and styrene butyl methacrylate copolymers of toner particle size, that is for example an average particle diameter of from about 3 to about 15 microns, and preferably from about 5 to about 10 microns.

As a further object of the present invention there are provided styrene butadiene and styrene butyl methacrylate copolymers of liquid toner or ink particle size, that is for example an average particle diameter of from about 0.1 to about 3 microns, and preferably from about 0.1 to about 1 micron.

In yet another object of the present invention there are provided colored polymer particles of a toner particle size of from about 0.1 to about 15 microns.

Moreover, another object of the present invention relates to the provision of processes for the preparation of polymers useful in paints.

In another object of the present invention there are provided processes wherein polymers with certain characteristics are obtained, which polymers can be selected as toner particles for dry and liquid toner compositions.

Furthermore, in another object of the present invention there are provided processes for obtaining positively or negatively charged toner and developer compositions useful for the development of images present on positively or negatively charged imaging members.

In yet another object of the present invention there are provided processes for obtaining two component toner compositions, single component toner compositions, and colored toner compositions.

These and other objects of the present invention are accomplished by processes for the preparation of polymer particles. More specifically, the process of the present invention comprises dissolving a polymer or copolymer in a solvent containing block or graft steric stabilizers, and precipitating polymer particles by the addition of a component in which the polymer is insoluble. In one embodiment of the present invention there is provided a process for the preparation of polymer particles which comprises the precipitation of a homopolymer, or copolymer A from a solution containing a sterically stabilizing block or graft polymer with A (or A-compatible) segments chemically bonded to B segments by the addition of a nonsolvent for A, which is also a solvent for B, thereby resulting in a sterically stabilized dispersion of polymer particles. The aforementioned particles can be used as is, or isolated for the preparation of toners. Additionally, surfactants, B homopolymer, dyes, and/or pigments can be added to the polymer product.

One embodiment of the present invention is directed to a process for the preparation of polymer particles which comprises dissolving a polymer in a solvent containing a block or graft steric stabilizer, and adding thereto a nonsolvent for the polymer, which nonsolvent functions as a solvent for the stabilizer chains of the block or graft steric stabilizer.

In another specific embodiment of the present invention, the process comprises the formation of toner particles with, for example, an average volume diameter of from about 0.1 to about 200 microns, which comprises dissolving from about 1 to about 100 parts of a polymer or copolymer A, together with from about 0.01 to about 10 parts of a block or graft stabilizer with A or A-compatible segments chemically bonded to B segments in 100 parts of a suitable solvent at a temperature of from about 0° to 100° C. Optional components, such as from about 1 percent by weight of the polymer to about 300 percent by weight of the polymer, or pigment or dye, from about 0.01 part to about 10 parts of a surfactant, or from about 0.1 part to about 10 parts of B homopolymer may also be added to the aforementioned mixture. The resulting mixture is agitated vigorously while from about 10 to about 10,000 parts of a nonsolvent for polymer A, which is a solvent for polymer B, is added at a rate of from about 0.01 to about 10,000 parts per minute. The product obtained may be employed directly as a liquid toner or ink, or the polymer particles may be isolated by known methods, including centrifugation, filtration, ultrafiltration, and spray or freeze drying.

Examples of A, preferably present in an amount of from about 1 to about 100 parts per 100 parts of solvent, include polystyrene, poly(*n*-butyl methacrylate), poly(2-ethylhexyl methaxrylate), poly(*n*-lauryl methacrylate), poly(stearyl methacrylate), poly(eicosane), copolymers of the above, copolymers of acrylates, methacrylates, styrene, substituted styrenes, 1,3-butadiene, isoprene, including styrene butadiene and styrene n-butyl methacrylate, and the like. Similarly, A can be a styrene n-butylmethacrylate copolymer (58/42 or 65/35, for example); a styrene butadiene copolymer, preferably prepared by suspension polymerization as illustrated in U.S. Pat. No. 4,560,635, the disclosure of which is totally incorporated herein by reference (89/11 or 91/9, for example).

Illustrative examples of B segments in the block or graft copolymer stabilizer, which stablizer is added in amounts of from about 0.01 to 10 parts per 100 parts of solvent, include hydroxypropyl cellulose, poly(N-vinylpyrrolidone), poly(acrylic acid), poly(vinylbutyral), poly(ethylene oxide), poly(propylene oxide), polyethylene, poly(butadiene), hydrogenated poly(butadiene), poly(isobutylene), and the like. The selection of the B segments depends upon the choice of A and the nonsolvent employed. For example, as steric stabilizers there may be selected components where A is styrenic, block or graft copolymers containing polystyrene blocks as the A-compatible segment together with hydrogenated poly(butadiene) blocks as the B segment providing, for example, that the nonsolvent is a nonpolar, for example, a hydrocarbon solvent which dissolves the B chains. Alternatively, if B is poly(N-vinylpyrrolidone), for example, the nonsolvent for A, which is a solvent for B, would be polar solvents such as aliphatic alcohols, for example methanol. The ratio of the molecular weight of the A chains and the B chains in the block or graft stabilizer is generally from about 0.02 to about 50, however, other ratios can be selected providing the objectives of the present invention are achieved.

Illustrative examples of block copolymer stabilizers preferably added in amounts of from about 0.01 to 10 parts per 100 parts of solvent, include commercially available materials such as diblock styrene butadiene or styrene isoprene copolymers, commercially available as Solprene from Phillips Chemical Company, diblock and triblock copolymers styrene-butadiene-styrene, styrene-/ethylene-co-butylene, styrene-isoprene-styrene, and hydrogenated materials prepared therefrom, and commercially available as Kraton from Shell Chemical Company, ethylene oxide/propylene oxide block copolymers, commercially available as Pluronics and Tetronics from BASF, polystyrene-b-polyethylene oxide, and the like.

Illustrative examples of graft copolymers are those formed when styrene is polymerized in alcohol in the presence of hydroxypropyl cellulose, poly(N-vinylpyrrolidone), poly(acrylic acid), poly(vinylbutyral), poly(ethylene oxide), poly(propylene oxide), polyethylene, poly(butadiene), hydrogenated poly(butadiene), poly(isobutylene), and the like. These grafted materials, for example, poly(styrene-g-hydroxypropyl cellulose), reside on the particle surface after dispersion polymerization. Thus, when dispersion polymerized polystyrene is used as polymer A, 0.5 percent to 5 percent by weight of graft on the surface of the original particles provides the necessary graft copolymer A-g-B for the process of the present invention in one embodiment.

The amount of block or graft copolymer employed depends on a number of factors including, for example, the molecular weights of the A and B segments, the radius of gyration of the B chain in solution, on the final particle size, and the like. Thus, for example, when samll particles (diameter) of from about 0.1 to 3 microns are desired, usually from about 0.1 to about 10 parts of block or graft copolymer stabilizer per 100 parts of solvent are selected. Should larger particles of from about 3 to about 200 microns be desired usually from about 0.01 to about 1 part of block or graft copolymer stabilizer per 100 parts of solvent are selected. When the B block is of high molecular weight, the radius of gyration is larger, allowing better stabilization.

Examples of suitable solvents preferably present in an amount of from about 1 to about 100 parts per part of polymer or copolymer A include those capable of dissolving both polymer or copolymer A and the graft or block copolymer stabilizer. For example, when A is styrenic, suitable solvents include tetrahydrofuran, methylene chloride, chloroform, trichloroethane, dioxane, benzene, toluene, xylene, dimethylacetamide dimethylformamide, and the like. Mixtures of solvents comprising of from about 0.5 part to about 99.5 parts of from 2 to 15 components from the aforementioned solvents may also be suitable.

Examples of suitable nonsolvents preferably present in an amount of from about 10 parts to about 10,000 parts per 100 parts of solvent although other effective amounts may be selected include those in which the A polymer is insoluble, and the B segments are soluble. For example, when A is styrenic and B is polar, including hydroxypropyl cellulose, poly(N-vinylpyrrolidone), poly(acrylic acid), poly(vinylbutyral), poly(ethylene oxide), and the like, suitable nonsolvents include methanol, ethanol, propanol, butanol, higher alcohols of the type $C_nH_{2n+1}OH$, when n varies from 5 to about 20, ethylene glycol, propylene glycol, 2-methoxyethanol, 2-ethoxyethanol, formic acid, acetic acid, and the like. Mixtures of nonsolvents comprising from about 0.5 part to about 99.5 parts of from 2 to 15 components from the aforementioned nonsolvents may also be suitable. Additionally, when A is styrenic, and B is nonpolar, including poly(12-hydroxystearic acid), poly(isobutylene), poly(isoprene), poly(2-ethylhexylmethacrylate), and copolymers thereof, and the like, suitable nonsolvents include hydrocarbons of the type $C_nH_{2n+2}$, when n varies from 5 to about 20, and the like. Mixtures of nonsolvents comprising from about 0.5 part to about 99.5 parts of from 2 to 15 components from the aforementioned hydrocarbons may also be suitable.

The rate of nonsolvent addition is one of the primary parameters for controlling the particle size. Thus, for example, when the rate of nonsolvent addition is varied, larger particles are usually obtained with slower addition rates. Particles suitable for toner applications of from about 3 to about 15 microns average particle diameter and preferably from about 5 to about 10 microns may be obtained by nonsolvent addition rates on the order of about 0.01 to about 100 parts per minute. Addition rates below 0.01 part per minute may cause undesired coagulum in some instances. Particles suitable for liquid toner or ink applications of from about 0.1 to about 3 microns and preferably from about 0.12 to about 1 micron may be obtained by nonsolvent addition rates of about 10 to about 10,000 parts per minute. If the addition rate is too fast, for example, greater than about 10,000 parts per minute, there is insufficient time for the particle formation and stabilization steps to operate properly, and massive coagulum may result in some embodiments.

With the process of the present invention, in one embodiment precipitation of particles of polymer or copolymer A from the solution in a suitable solvent may be accomplished at any suitable temperature including from about 0° to about 100° C. providing the initial solution of polymer A and block or graft stabilizer containing A-compatible and B segments is homogeneous, and providing the polymer A becomes insoluble during the addition of no-solvent, forming stable particles.

Temperatures below 0° C. or above 100° C. are often uneconomical.

Illustrative examples of optional B homopolymers, preferably added in amounts of from about 0.1 part to about 10 parts per 100 parts of solvent, include hydroxypropyl cellulose, poly(N-vinylpyrrolidone), poly(acrylic acid), poly(vinylbutyral), poly(ethylene oxide), poly(propylene oxide), polyethylene, poly(butadiene), hydrogenated poly(butadiene), poly(isobutylene) and the like. These materials may be added to assist the steric stabilization of the product particles provided the B homopolymer remains soluble in the mixture at all times. Without being limited by theory, it is believed that such materials modify the radius of gyration of the adsorbed block or graft B chains on the particle surface improving the steric stabilization.

Illustrative examples of optional surfactants, preferably added in amounts of from about 1 percent by weight of the polymer to about 300 percent by weight of the polymer, which may be selected for the process of the present invention, include neutral, anionic, cationic, and ambiphilic surfactants, such as nonylphenyl poly(ethylene oxides), stearates, sulfosuccinates, quaternary ammonium salts, and the like.

The resulting polymer particles can be selected as toner resins for toner and developer compositions containing pigment particles and optional additive components. One toner composition embodiment encompasses dyeing or pigmenting the polymer product obtained by the process illustrated herein by various suitable known methods, and selecting them directly as toner size particles for toners or developers without jetting.

More specifically, toner size particles of from about 1 to about 20 microns, and preferably from about 8 to about 15 microns average volume diameter can be optionally treated with alkyl halides or alcohols or carboxylic acids to chemically modify the surface groups and thereby change the triboelectric charging level to about 5 to 50 microcoulombs per gram as illustrated in U.S. Pat. No. 4,652,508, the disclosure of which is totally incorporated herein by reference. These particles may then be colored by a variety of methods, including those described in Example XXI hereinafter, or by adding the pigment or dye together with the other components, or by any other suitable method.

Numerous well known suitable pigments can be selected as the colorant for the toner particles including, for example, carbon black, nigrosine dye, aniline blue, phthalocyanine derivatives, magnetites, and mixtures thereof. The pigment should be present in a sufficient amount to render the toner composition colored thereby permitting the formation of a clearly visible image. Generally, the amount of pigment particles depends upon the particle size; smaller particles require larger amounts of pigment to achieve the same image density from monolayer coverage. Thus, pigment particles or dyes are present in amounts of from about 1 percent by weight to about 25 percent by weight of the polymer for dry toner compositions of from about 3 to about 15 microns, and from about 10 percent by weight to about 300 percent by weight of the polymer for liquid toner or ink compositions of from about 0.1 to about 3 microns. However, lesser or greater amounts of pigment particles can be selected providing the objectives of the present invention are achieved.

Also encompassed within the scope of the present invention are colored toner compositions containing as pigments or colorants red, blue, green, brown, magenta, cyan, and/or yellow particles, as well as mixtures thereof. More specifically, with regard to the generation of color images utilizing the toner and developer compositions described herein illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlet, Hostaperm, Fanal Pink D, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue identified in the Color Index as CI 69810, Special Blue X-2137, Sudan Blue, and the like; while illustrative examples of yellow pigments that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, red, blue, green, brown, Lithol Scarlet, and the like. These pigments are generally present in the toner composition in an amount of from about 1 percent to about 300 percent based on the weight of the polymer.

Specific examples of polymer A/AB stabilizer/solvent/nonsolvent combinations encompassed by the process of the present invention include, but are not limited to, the following. A may be poly(styrene-co-butyl methacrylate), and AB may be Kraton 1701, a diblock copolymer of styrene and ethylene-co-butylene available from Shell. In this situation, the A compatible block is polystyrene, and B is poly(ethylene-co-propylene), and a hydrocarbon such as heptane, isooctane, or an Isopar from Exxon is selected as the nonsolvent. The solvent may be any mutual solvent for styrene and poly(ethylene-co-butylene), including, for example, tetrahydrofuran, methylene chloride, and the like. The precipitation involves dissolving the A polymer in tetrahydrofuran with a small amount of the AB copolymer, then adding the hydrocarbon nonsolvent at a controlled rate. If the rate of nonsolvent addition is rapid, as indicated herein, small particles suitable for inks are formed. When the rate of nonsolvent addition is slower as indicated herein, larger particles suitable for dry toners may be formed.

Another specific example of a polymer A/AB stabilizer/solvent/nonsolvent combination encompassed by the process of the present invention is dispersion polymerized particles of polystyrene which were prepared with, for example, hydroxypropyl cellulose stabilizer dissolved in methylene chloride. In this situation, the graft stabilizer necessary for particle formation during precipitation is available from the surface of the dispersion polymerized particles where it was previously formed during dispersion polymerization. No further stabilizer is normally necessary. The polymer A can be successfully precipitated with a polar nonsolvent such as methanol or ethanol.

The precipitation of polymers is, as indicated herein, well known isolation and purification process which usually produces large flocs or gummy materials unsuitable for toners or inks. However, with the processes of the present invention in some embodiments, and in the presence of sterically stabilizing block or graft copolymers in an appropriate liquid medium comprised of solvent and nonsolvent as detailed herein, the normal uncontrolled precipitation is interrupted and stable latexes result. These materials have the block or graft stabilizer on the particle surface preventing further coalescence.

Polymer particle sizes, which can be obtained by the process of the present invention, are of an average diameter of from about 0.1 micron to about 200 microns, depending upon the process conditions, especially the rate of nonsolvent addition. For example, particle sizes of from about 0.1 micron to about 3 microns are suitable for liquid toner or ink applications, such particles having the advantages of waterfastness and sharp edge acuity. In addition, particle sizes of from about 3 microns to about 20 microns can be obtained which are suitable for dry xerographic toner applications. Furthermore, the aforementioned toner particles of from about 5 to about 10 microns may be employed for high resolution xerography.

Without being desired to limit by theory, it is believed that the precipitation process of the present invention functions as follows. First, the solution of polymer and stabilizer is homogeneous. As nonsolvent is added, the higher molecular weight polymer, and later the lower molecular weight polymer chains precipitate from solution by homogeneous nucleation. These nuclei are unstable and coalesce with one another to grow into larger and larger entities while new nuclei are also formed. If there is no block or graft stabilizer present, this coalescence would be uncontrolled and continue until only one or two large stringy lumps of polymer resulted. However, after an intermediate amount of nonsolvent has been added in the presence of the stabilizer, the polymer compatible A chains of the stabilizer adsorb onto the growing particles. When enough stabilizer has adsorbed to provide effective steric stabilization, further coalescence is prevented, enabling a sterically stabilized latex. One of the main reasons that the particle size depends upon the addition rate of nonsolvent is that different degrees of coalescence of nuclei can occur between the point where polymer nucleation begins and the point where block or graft copolymer adsorption begins.

An advantage with the process of the present invention is that the precipitation process functions with a wider variety of materials, including those which cannot be jetted in conventional melt blending, extrusion and micronization processes such as styrene butadiene copolymers with butadiene contents of greater than 15 percent by weight, styrene butyl methacrylate copolymers with butylmethacrylate contents greater than about 60 percent, hydrocarbon resins with melting points below about 125° C., and the like. Additionally, small scale quantities of particles of from about 1 gram to about 10 kilograms can be prepared which are suitable for preparation of custom color toners for use in corporate letterheads, business cards, or the like, or for the preparation of small samples for testing purposes.

With further respect to specific process embodiments of the process of the present invention, some of which have been illustrated hereinbefore, the process of the present invention allows for the independent control of bulk properties such as melting temperature, color, glass transition temperature and of surface properties, such as triboelectric charge, humidity sensitivity, flow, and the like. The bulk properties are controlled by the selection of the polymer or copolymer resin A to be precipitated, while the surface properties are determined by the choice of stabilizer nonsolvent compatible B block. The process of the present invention enables the preparation of polymer particles useful for paints, chromatographic supports, toners, and the like. Moreover, the process of the present invention offers opportunities to convert the products of emulsion polymerization, suspension polymerization, and dispersion polymerization into products with particle sizes different than that originally synthesized. Decoupling of particle size and polymer properties enables the preparation of particles for liquid and dry toners and inks.

Illustrative examples of suitable particles selected for the toner and developer compositions illustrated herein and present in various effective amounts such as, for example, from about 70 percent by weight to about 95 percent by weight, include the polymers illustrated herein such as styrene butadiene polymers inclusive of those with a weight average molecular weight of from about 10,000 to about 500,000, a molecular weight dispersity greater than 3 and preferably greater than 5, a ratio of styrene to butadiene of from about 70 to about 95 percent of styrene, and from about 5 to about 30 percent of butadiene, and preferably from about 80 to about 95 percent of styrene, and from about 5 to about 20 percent of butadiene.

Illustrative examples of optional charge enhancing additives present in various effective amounts, such as, for example, from about 0.1 to about 20 percent by weight, include alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; other known similar charge enhancing additives; and the like. Generally, the triboelectric charge on the toner is preferably from about a negative or positive 10 to about 40 microcoulombs per gram as determined by the known Faraday Cage method.

Developer compositions comprised of the aforementioned toners and carrier particles can also be prepared. Therefore, the developer compositions are comprised of toner compositions containing the polymers, or polymer obtained by the process illustrated herein; pigment particles such as cyan, magenta, yellow, red, green, brown; magnetites, carbon blacks or mixtures thereof; and optional additives such as charge control components, particularly, for example, distearyl dimethyl ammonium methyl sulfate, reference U.S. Pat. No. 4,560,635, the disclosure of which is totally incorporated herein by reference; metal salts of fatty acids; silica particles, preferably a surface additive in an amount of from 0.1 to 1 weight percent; and the like.

Examples of specific carrier particles that can be selected for mixing with the toner compositions illustrated herein include those particles that are capable of triboelectrically obtaining a charge of opposite polarity to that of the toner particles. Accordingly, the carrier particles of the present invention can be selected so as to be of a negative polarity thereby enabling the toner particles, which are positively charged,k to adhere to and surround the carrier particles. Alternatively, there can be selected carrier particles with a positive polarity enabling toner compositions with a negative polarity. Illustrative examples of carrier particles that may be selected include granular zircon, steel, nickel, iron, ferrites, and the like. Additionally, there can be selected as carrier particles, especially for colored developers such as cyan compositions, nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover, several of which are illustrated, for example, in U.S. Ser. No. 751,922 (now abandoned) relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Pat. No. 4,937,166 and U.S. Pat. No. 4,935,326, the disclosures of which are totally incorporated herein by reference. More specifically, there is detailed in this application a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed. Also, the coating carrier weight is usually present in an effective known amount, such as from about 0.1 to about 3 weight percent.

In addition, the toner and developer compositions illustrated herein may be selected for use in developing images in electrophotographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Other photoresponsive devices useful in the present invention include 4-dimethylaminobenzylidene; 2-benzylidene-amino-carbazole; (2-nitro-benzylidene)-*p*-bromoaniline; 2,4-diphenyl-quazoline; 1,2,4triazine; 1,5-diphenyl-3-methyl pyrazoline; 2-(4'-dimethyl-amino phenyl)benzoaxzole; 3-aminocarbazole; hydrazone derivatives; polyvinyl carbazole-trinitrofluorenone charge transfer complex; and mixtures thereof. Moreover, there can be selected as photoconductors hydrogenated amorphous silicon; and as photogenerating pigments squaraines, perylenes; and the like.

Moreover, the toner and developer compositions of the present invention are particularly useful with electrophotographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles; means for causing the flexible imaging means to move at a speed of from about 5 centimeters/second to about 50 centimeters/-second; means for causing the transporting means to move at a speed of from about 6 centimeters/second to about 100 centimeters/second; the means for imaging and the means for transporting moving at different speeds; and the means for imaging and the means for transporting having a distance therebetween of from about 0.05 millimeter to about 1.5 millimeters.

With the polymer particles obtained with the processes of the present invention, liquid developer compositions may also be formulated, which liquid developers are well known and include aqueous or petroleum distillates. More specifically, one liquid ink composition that can be formulated is comprised of an effective amount of from about 1 percent to about 50 percent by weight of the polymer particles obtained with the processes of the present invention dispersed in Isopars such as Isopar G, and the like, pigment particles, optional humectants, stabilizing agents, surfactants, and the like. Liquid developers are illustrated, for example, in U.S. Pat. Nos. 4,797,342 and 4,789,616, the disclosures of which are totally incorporated herein by reference.

The following examples are being submitted to further define various species of the present invention. These examples are intended to illustrate and not limit the scope of the present invention. Also, parts and percentages are by weight unless otherwise indicated. Molecular weights were determined on a Hewlett-Packard 1090 gel permeation chromatograph in THF solvent at one milliliter per minute. The instrument was calibrated with monodisperse polystyrene standards from Pressure Chemical. The amount of graft on the surface of dispersion polymerized particles was measured by first labelling the stabilizer, for example hydroxypropyl cellulose, with fluorescent pyrene units, then preparing dispersion polymerized particles from this pyrene labelled stabilizer, and analyzing the pyrene content in the final particles by uv-visible spectrometry. It was also observed that the molecular weight of the hydroxypropyl cellulose increased by an amount equal to the grafted molecular weight of polystyrene formed in the dispersion polymerization. Transmission electron microscopic investigations of sectioned particles evidenced that the graft was at the particle surface with, for example, hydroxypropyl cellulose, poly(N-vinylpyrrolidone), poly(vinylbutyral), and poly(acrylic acid).

EXAMPLE I

A dispersion polymerized polystyrene product which contained about 1 to 2 weight percent of poly(styrene-g-hydroxypropyl cellulose) on the particle surface was prepared as follows:

A solution of ethanol, 175 milliliters, and 2-methoxyethanol, 175 milliliters, containing predissolved hydroxypropyl cellulose from Scientific Polymer Products of a weight average molecular weight of 100,000, 7.5 grams, was added to a 1 liter round bottom flask. The flask contents were stirred and heated to 65° C. at which time a solution of styrene, 75 milliliters, 68 grams, and benzoyl peroxide, 3.0 grams, was added. The reaction was allowed to continue at 65° C. for 3.2 hours, then the temperature was increased to 75° C. for a further 17 hours. The flask was then cooled to 40° C. and the contents washed out with ethanol. The dispersion polymerized polystyrene product particles were washed twice with methanol and twice with water, then redispersed in approximately 10 parts of water per part of polymer resin, frozen in an isopropanol bath chilled to minus 60° C., then freeze dried for 24 hours. The yield of product was 80 percent.

EXAMPLE II

Precipitated particles of approximately 1 micron in size, apparent average diameter, as determined by optical microscopy, were obtained from the dispersion polymerized polystyrene product of Example I as follows:

A solution of the polymer prepared in Example I was prepared by dissolving the polymer resin, 0.50 gram, in tetrahydrofuran, 10 milliliters, in a 100 milliliter beaker furnished with vigorous magnetic stirring. Once the polymer resin had dissolved, methanol, 70 milliliters, was added to the stirring mixture with a peristaltic pump, available from Cole Parmer, at a rate of 140 milliliters per minute. The solution became cloudy after approximately 7 milliliters of methanol had been added. The resulting latex was stirred for 30 minutes, then centrifuged, and washed twice with methanol to yield a latex dispersion of polystyrene particles. Dry polymer particles were isolated by washing twice with water, then redispersing in approximately 10 parts of water per part of resin, freezing in an isopropanol bath, and freeze drying, to provide dry one micron average particle diameter precipitated particles of polystyrene.

EXAMPLES III TO V

Repeating the procedure of Example II, but varying the addition rate of the methanol nonsolvent, the following results were obtained:

| Example | Methanol Addition Rate (milliliters per minute) | Particle Size Range (micron) |
|---|---|---|
| II | 140.0 | 1 |
| III | 46.0 | 1.5 to 3.5 |
| IV | 1.25 | 2 to 5 |
| V | 0.17 | 5 to 40 (+coagulum) |

These examples evidence the effect of the rate of nonsolvent addition on the particle size.

EXAMPLE VI

Precipitated particles of approximately 1 to 3 microns typical diameter, as determined by optical microscopy, were obtained from the dispersion polymerized polystyrene product of Example I as follows:

A solution of the polymer prepared in Example I, 0.190 gram, together with polystyrene of monodisperse molecular weight 35,000 obtained, from Pressure Chemical, 0.311 gram, in dioxane, 10 milliliters, was prepared in a 100 milliliter beaker furnished with vigorous magnetic stirring. Once the aforesaid polymer resins had dissolved, methanol, 70 milliliters, was added to the stirring mixture with a peristaltic pump from Cole Parmer, at a rate of 168 milliliters per minute. The solution became cloudy after approximately 11 milliliters of methanol had been added. The resulting latex was stirred for 30 minutes, then centrifuged, and washed twice with methanol to yield a latex dispersion of polystyrene particles. Dry polymer particles were isolated by washing twice with water, then redispersing in approximately 10 parts of water per part of resin, freezing in an isopropanol bath, and freeze drying, to provide dry, from about 1 to about 3 microns precipitated particles of polystyrene.

EXAMPLE VII

Precipitated particles of approximately 580 nanometers in size, as determined by Brookhaven BI-90 light scattering apparatus, were obtained from a styrene butadiene copolymer as follows:

A solution of a copolymer of styrene butadiene comprised of approximately 11 weight percent butadiene and approximately 89 weight percent styrene as obtained from suspension polymerization was prepared by dissolving this resin, 5.0 grams, together with Kraton 1701 stabilizer, a styrene/ethylene-co-butylene diblock copolymer of nominal molecular weight 200,000, obtained from Shell Chemical, 0.750 gram, in tetrahydrofuran, 50 milliliters, in a 125 milliliter polypropylene bottle. The solution was mixed on a roll mill for approximately 3 hours to ensure that the polymer and stabilizer had dissolved completely. The solution was transferred to a 1 liter beaker, and mixed with a Brinkmann Polytron homogenizer with a 35-G probe at 9,000 rpm. To the homogenizing solution, heptane, 700 milliliters, was added with a Cole Parmer peristaltic pump at a rate of 2,000 milliliters per minute. The resulting latex was stirred for an additional two minutes, then filtered through a 74 micron Teflon mesh under vacuum to provide a latex dispersion of styrene butadiene copolymer particles. The tetrahydrofuran and excess heptane were removed on a rotary evaporator to provide a latex dispersion of from about 1 percent to about 10 percent by weight of the styrene butadiene particles in heptane.

EXAMPLE VIII

Precipitated magenta particles of approximately 570 nanometers in size (average particle volume diameter throughout), as determined by Brookhaven BI-90 light scattering apparatus, which are suitable for use as a liquid toner, were obtained from a styrene butadiene copolymer as follows:

A solution of a copolymer of styrene butadiene comprised of approximately 11 weight percent butadiene and approximately 89 weight percent styrene obtained by suspension polymerization was prepared by dissolving this resin, 5.0 grams, together with Kraton 1701 stabilizer, a styrene/ethylene-co-butylene diblock copolymer of nominal molecular weight 200,000, obtained from Shell Chemical, 0.750 gram, in tetrahydrofuran, 50 milliliters, in a 125 milliliter polypropylene bottle. The solution was mixed on a roll mill for approximately 3 hours to ensure that the polymer and stabilizer had dissolved completely. The solution was transferred to a 1 liter beaker containing Hostaperm Pink E pigment obtained from Hoescht, 2.5 grams, and mixed with a Brinkmann Polytron homogenizer with a 35-G probe at 9,000 rpm. To the homogenizing solution, heptane, 700 milliliters, was added with a Cole Parmer peristaltic pump at a rate of 2,000 milliliters per minute. The resulting latex was stirred for an additional two minutes, then filtered through a 74 micron Teflon mesh under vacuum. The volume of filtrate was reduced to 250 milliliters using a rotary evaporator. The concentrated solution was centrifuged at 3,000 rpm for 15 minutes and the remaining solvent was decanted off and the particles redispersed in heptane, 50 milliliters, by sonicating for 10 minutes. Paint brush application of the above prepared magenta dispersion to paper resulted in rapid drying within 30 seconds to a permanent waterfast (100 percent waterfastness) image which was unaffected under running water for one hour, and no edge feathering was observed.

EXAMPLE IX

Precipitated magenta particles of approximately 580 nanometers in size, as determined by Brookhaven Bl-90 light scattering apparatus, which are suitable for use as a liquid toner, were obtained from a styrene butadiene copolymer by repeating the procedure of Example VIII except that the pigment Fanal Pink, from BASF, was substituted for the Hostaperm Pink E.

EXAMPLE X

Precipitated particles of a copolymer of styrene and n-butyl methacrylate comprised of approximately 52 percent by weight of styrene and 48 percent by weight of *n*-butyl methacrylate, were prepared as follows:

A solution of the above copolymer was prepared by dissolving the resin, 0.588 gram, together with Kraton 1701 stabilizer, a styrene/ethylene-co-butylene diblock copolymer of nominal molecular weight of 200,000 from Shell, 0.034 gram, in tetrahydrofuran, 5.9 milliliters, in a 125 milliliter beaker. The solution was stirred vigorously to ensure that the polymer and stabilizer dissolved completely. To the stirred solution, Isopar G, a hydrocarbon solvent obtained from Exxon, 90 milliliters, was added with a Cole Parmer peristaltic pump at a rate of 25 milliliters per minute. The resulting latex was stirred for an additional 10 minutes then filtered through a 74 micron Teflon mesh under vacuum. The tetrahydrofuran was removed using a rotary evaporator to provide a 0.7 percent dispersion of styrene butylmethacrylate copolymer particles in Isopar G. Additional Isopar may also be removed by distillation to increase the latex concentration.

EXAMPLE XI

A dispersion polymerized copolymer of styrene and butadiene of weight average molecular weight of 112,300, and molecular weight dispersity of 7.0, composed of particles of volume average 3.6 micron diameter, as determined by the Coulter Multisizer analysis, which particles contain from about 0.5 percent to about 3 percent of grafted poly(styrene-co-butadiene-g-hydroxypropyl cellulose) on the particle surface was prepared as follows:

A solution of ethanol, 240 milliliters, and 1-propanol, 240 milliliters, containing predissolved hydroxypropyl cellulose obtained from Scientific Polymer Products of nominal molecular weight of 100,000, 8.4 grams, was added to a 1 liter Parr pressure reactor. The reactor was sealed and flushed with nitrogen gas. The reactor contents were stirred at about 300 rpm and heated to 72.5° C., at which time a solution of styrene, 75 milliliters, benzoyl peroxide, 1.532 grams, and freshly distilled 1,3-butadiene, 8.82 grams, was added via a sparge tube, under a nitrogen gas pressure of 60 psi. The reaction was allowed to continue at 72.5° for 43 hours. The reactor was cooled to 40° and the contents washed out with ethanol. The dispersion polymerized styrene butadiene copolymer product particles were washed twice with methanol and twice with water, then redispersed in approximately 10 parts of water per part of resin, frozen in an isopropanol bath chilled to minus 60°, then freeze dried for 24 hours. The yield of product was 53 percent.

EXAMPLE XII

Precipitated blue styrene butadiene particles less than 1 micron in average diameter size, which are suitable for use as a liquid toner, were obtained from the product of Example XI as follows:

A solution of the polymer prepared in Example XI was prepared by dissolving the resin, 2.5 grams, in tetrahydrofuran, 25 milliliters, in a 125 milliliter polyethylene bottle. The solution was mixed on a roll mill for approximately 3 hours to ensure that the polymers had dissolved completely. The solution was transferred to a 1 liter beaker containing Neopen Blue pigment obtained from BASF, 0.75 gram, and the resulting mixture stirred magnetically at 500 rpm. To the stirring solution, ethanol, 350 milliliters, was added with a Cole Parmer peristaltic pump at a rate of 2,000 milliliters per minute. The resulting latex was stirred for an additional two minutes, the filtered through a 20 micron nylon mesh under vacuum. Ethylene glycol, 15 milliliters, was added to the filtrate and the ethanol and tetrahydrofuran removed on a rotary evaporator until only the ethylene glycol and polymer portion remained. Water, 15 milliliters, was added to the ethylene glycol mixture to create a liquid toner. The performance of the ink was evaluated by applying it to paper using a paint brush. Excellent optical density (1.2) and waterfastness (95 percent) were obtained.

EXAMPLE XIII

Precipitated colored styrene butadiene particles, 7.8 microns in average diameter size, as determined by Coulter Multisizer, which are suitable for use as a dry toner, were obtained from the product of Example XI as follows:

A solution of the polymer prepared in Example XI was prepared by dissolving the resin, 2.5 grams, in tetrahydrofuran, 25 milliliters, in a 125 milliliter polyethylene bottle. The solution was mixed on a roll mill for approximately 3 hours to ensure that the polymers had dissolved completely. The solution was transferred to a 1 liter beaker containing Neopen Blue pigment obtained from BASF, 0.25 gram, and the resulting mixture stirred magnetically at 500 rpm. To the stirring solution, ethanol, 350 milliliters, was added with a Cole Parmer peristaltic pump at a rate of 700 milliliters per minute. The resulting latex was stirred for an additional 5 minutes, then filtered through a 74 micron Teflon mesh under vacuum. Using a rotary evaporator, the volume was reduced to approximately 250 milliliters. The concentrated solution was allowed to settle and the solvent was decanted off. The particles resulting were redispersed in methanol, 50 milliliters, with sonication, centrifuged at 3,000 rpm for 15 minutes, and the solvent decanted off. This washing process was repeated twice with methanol and finally with water. The colored precipitated styrene butadiene product particles were redispersed in approximately 10 parts of water per part of polymer resin product, frozen in an isopropanol bath chilled to minus 60° C., then freeze dried on a FTS Systems DuraDry Freeze Drier.

EXAMPLES XIV TO XVIII

Repeating the procedure of Example XIII with different solvents and nonsolvents, the pigment added, and the rate of nonsolvent addition, similar particles were obtained with the following particle size average diameter.

| Example | Pigment | Solvent | Non-solvent | Addition Rate (milliliters per minute) | Particle Size (micron) |
|---|---|---|---|---|---|
| XIII | Neopen Blue | THF | Ethanol | 700 | 7.8 |
| XIV | None | THF | Ethanol | 250 | 7.9 |
| XV | Neopen Blue | THF | $CH_3OH$ | 200 | 14.8 |
| XVI | Fanal Pink | $CH_2Cl_2$ | $CH_3OH$ | 350 | 9.2 |
| XVII | Fanal Pink | THF | Ethanol | 20 | 12.1 |
| XVIII | Carbon Black | THF | Ethanol | 100 | 5.6 |

EXAMPLE XIX

A dispersion polymerized copolymer product of styrene and n-butylmethacrylate of weight average molecular weight of 40,000 and molecular weight dispersity of 1.8, and having from about 1 to about 3 percent of grafted poly(styrene-co-n-butyl methacrylate-g-N-vinylpyrrolidone) stabilizer on the particle surface was prepared as follows:

A solution of ethanol, 500 milliliters, containing predissolved poly(N-vinylpyrrolidone) of nominal molecular weight 40,000, obtained from PolySciences, 10.0 grams, and Triton N-57, obtained from Rohm and Haas, 10.0 grams, was added to a 1 liter round bottom flask. The flask contents were stirred and heated to 70° C., at which time a solution of styrene, 78 milliliters, 71.55 grams, n-butyl methacrylate, 50 milliliters, 45.4 grams, and azobis(isobutyronitrile), 1.17 grams, was added. The reaction was allowed to continue at 70° C. for 48 hours. The flask was then cooled to 40° C. and the contents washed out with ethanol. The dispersion polymerized styrene n-butylmethacrylate copolymer product particles were washed twice with methanol and twice with water, then redispersed in approximately 10 parts of water per part of resin, frozen in an isopropanol bath chilled to minus 60° C., then freeze dried for 24 hours. The yield of product was 72 percent.

EXAMPLE XX

Precipitated blue styrene n-butyl methacrylate copolymer particles less than 1 micron in average particle diameter size, which are suitable for use as a liquid toner, were obtained from the product of Example XIX as follows:

A solution of the polymer prepared in Examle XIX was prepared by dissolving the above styrene n-butyl methacrylate copolymer, 2.5 grams, in methylene chloride, 25 milliliters, in a 125 milliliter polyethylene bottle. The solution was mixed on a roll mill for approximately 3 hours to ensure that the polymer had dissolved completely. The solution was transferred to a 1 liter beaker containing Neopen Blue pigment obtained from BASF, 0.75 gram, and the resulting mixture stirred magnetically at 500 rpm. To the stirring solution, methanol, 350 milliliters, was added with a Cole Parmer peristaltic pump at a rate of 20 liters per minute. The resulting latex was stirred for an additional two minutes then filtered through a 20 micron nylon mesh under vacuum. Ethylene glycol, 15 milliliters, was added to the filtrate and the ethanol and methylene chloride removed on a rotary evaporator until only the ethylene glycol and polymer portion remained. Water, 15 milliliters, was added to the ethylene glycol mixture to generate a liquid toner. The performance of the resulting liquid ink was evaluated by applying it to paper using a paint brush. Excellent optical density and waterfastness (97 percent) resulted.

EXAMPLE XXI

Colored toner particles can be prepared from the copolymer particles obtained from the processes of Examples II to VII, Example X, or Example XIV as follows:

A sample of the selected copolymer product particles, 1.8 grams, can be placed in a 30 milliliter reaction bottle together with 0.10 gram of pigment (for example, Permanent Yellow FGL, Fanal Pink, Lithol Scarlet, Hostaperm Pink E, Neopen Blue, or the like) and 10 milliliters of a solution of five percent poly(N-vinylpyrrolidone), molecular weight of 360,000, in methanol. The bottle can then be sealed and shaken for three hours at room temperature during which time the pigment can migrate into the particles. The colored toner comprised of copolymer product particles containing 6 percent pigment can be isolated by washing twice with water, followed by dispersion in water and freeze drying.

EXAMPLE XXII

A solution of polystyrene of a monodisperse molecular weight of 35,000, obtained from Pressure Chemical, 0.502 gram, together with hydroxypropyl cellulose of nominal molecular weight of 100,000, from Scientific Polymer Products, 0.125 gram, in dioxane, 10 milliliters, was prepared in a 100 milliliter beaker furnished with vigorous magnetic stirring. Once the resins had dissolved, methanol, 70 milliliters, was added to the stirring mixture with a Cole Parmer peristaltic pump at a rate of 140 milliliters per minute. The solution became cloudy after approximately 7 milliliters of methanol had been added. The resulting flocculated polystyrene material was stirred for 30 minutes, then centrifuged, and washed twice with methanol to yield 100 micron flocs of unstabilized polystyrene.

EXAMPLE XXIII

A solution of polystyrene of a monodisperse molecular weight of 35,000, obtained from Pressure Chemical, 0.469 gram, together with hydroxypropyl cellulose of nominal molecular weight of 100,000, obtained from Scientific Polymer Products, 0.486 gram, in dioxane, 20 milliliters, was prepared in a 250 milliliter beaker furnished with vigorous magnetic stirring. Once the resins had dissolved, methanol, 60 milliliters, was added to the stirring mixture with a Cole Parmer peristaltic pump at a rate of 0.35 milliliter per minute. The solution became cloudy after approximately 11 milliliters of methanol had been added. The polystyrene product consisted of a gum on the sides of the beaker, and there were substantially no latex particles visible by optical microscopy.

The graft stabilizer in working Examples II to VI was polystyrene-g-hydroxypropyl cellulose formed during the dispersion polymerization of Example I. Working Examples II to VI evidence the formation of stable particles while with Example XXII stabilized polymer floc particles do not result.

Other modifications of the present invention may occur to those skilled in the art subsequent to a review of the present application. The aforementioned modifications, including equivalents thereof, are intended to be included within the scope of the present invention.

What is claimed is:

1. A process for the preparation of toner with an average volume diameter of from about 0.1 micron to about 200 microns consisting essentially of dissolving in a first solvent from about 1 to about 100 parts of a homopolymer selected from the group consisting of polyesters, poly(*n*-butyl methacrylate), poly(2-ethylhexyl methacrylate), poly(*n*-lauryl methacrylate), poly(stearyl methacrylate), poly(eicosane), copolymers thereof, and copolymers thereof with styrene or butadiene together with from about 0.01 to about 10 parts of a block or graft stabilizer with A or A-compatible segments chemically bonded to B segments in 100 parts of the first solvent at a temperature of from about 0° to 100° C., and agitating vigorously while from about 10 to about 10,000 parts of a second nonsolvent for polymer A, which is a solvent for polymer B, is added at a rate of from about 0.01 to about 10,000 parts per minute, and wherein said stabilizing block copolymer is of the formula AB, ABA, or BAB wherein A and B represent polymer segments of styrene isoprene copolymers, diblock and triblock copolymers of styrene-butadiene-styrene, styrene/ethylene-co-butylene, styrene-isoprene-styrene, hydrogenated materials thereof, ethylene oxide/propylene oxide block copolymers or polystyrene-*b*-polyethylene oxide; subsequently isolating the polymer particles and admixing therewith pigment or dye components.

2. A process in accordance with claim 1 wherein the stabilizing copolymer is located on or dispersed in the polymer particles.

3. A process in accordance with claim 2 wherein the stabilizing copolymer is poly(styrene-*g*-hydroxypropyl cellulose), poly(styrene-*g*-N-vinylpyrrolidone), poly(methylmethacrylate-*g*-isobutylene), poly(styrene-co-butadiene-*g*-N-vinylpyrrolidone), poly(styrene-co-butadiene-*g*-hydroxypropyl cellulose), poly(styrene-co-*n*-butylmethacrylate-*g*-N-vinylpyrrolidone), or poly(styrene-co-*n*-butylmethacrylate-*g*-hydroxypropyl cellulose).

4. A process in accordance with claim 1 wherein the first solvent is tetrahydrofuran, methylene chloride, chloroform, trichloroethane, dioxane, benzene, toluene, xylene, dimethylacetamide or dimethylformamide.

5. A process in accordance with claim 1 wherein the solvent is methanol, ethanol, propanol, butanol, alcohols of the formula $C_nH_{2n+1}OH$, when n is a number of from about 5 to about 20, hydrocarbons of the formula $C_nH_{2n+2}$, wherein n is a number of from about 5 to about 20, ethylene glycol, propylene glycol, 2-methoxyethanol, 2-ethoxyethanol, formic acid, or acetic acid.

6. A process in accordance with claim 1 wherein the second nonsolvent is an aliphatic alcohol, an aliphatic glycol, or a carboxylic acid.

7. A process in accordance with claim 1 wherein the nonsolvent is comprised of linear aliphatic alcohols, branched aliphatic alcohols, cyclohexanol, methoxyethanol, ethoxyethanol, acetic acid, and propanoic acid.

8. A process in accordance with claim 1 wherein the polymer is styrene-co-butadiene or styrene-co-*n*-butylmethacrylate and the stabilizer is Kraton 1701, poly(styrene-co-butadiene-*g*-N-vinylpyrrolidone), poly(styrene-co-butadiene-*g*-hydroxypropyl cellulose), poly(styrene-co-*n*-butylmethacrylate-*g*-N-vinylpyrrolidone), or poly(styrene-co-*n*-butylmethacrylate-*g*-hydroxypropyl cellulose).

9. A process in accordance with claim 1 wherein there results precipitation of the polymer at a temperature of from about 0° to about 100° C.

10. A process in accordance with claim 1 wherein a grafted nonpolar steric stabilizer is selected from the group consisting of polystyrene or poly(styrene-co-butadiene), or poly(styrene-co-*n*-butylmethacrylate) grafted to poly(12-hydroxystearic acid), poly(isobutylene, poly(isoprene), poly(2-ethylhexylmethacrylate) and copolymers thereof.

11. A process in accordance with claim 1 wherein the steric stabilizer is selected from the group consisting of polystyrene, poly(styrene-co-butadiene), poly(styrene-co-*n*-butyl methacrylate) grafted to hydroxypropyl cellulose, methyl cellulose, poly(vinyl pyrrolidone), poly(vinyl butyral), poly(ethylene oxide), poly(acrylic acids), and poly(vinyl pyridine).

12. A process in accordance with claim 1 wherein the polymer particles are isolated by centrifugation, filtration, ultrafiltration, and/or spray or freeze drying.

13. A process for the preparation of a toner composition consisting essentially of steric stabilized polymer particles which particles have an average volume diameter of from about 0.1 micron to about 200 microns, which comprises dissolving in a first solvent from about 1 to about 100 parts of a polymer or copolymer A together with from about 0.01 to about 10 parts of a block or graft stabilizer with A or A-compatible segments chemically bonded to B segments in 100 parts of the first solvent at a temperature of from about 0° to 100° C., and agitating vigorously while from about 10 to about 10,000 parts of a second nonsolvent for polymer A, which is a solvent for polymer B, are added at a rate of from about 0.01 to about 10,000 parts per minute thereby causing precipitation of said polymer particles containing the block or graft polymeric stabilizer on the surface thereof, subsequently isolating the polymer particles and admixing therewith pigment or dye components.

14. A process in accordance with claim 13 wherein the pigment particles are carbon black, magnetite or mixtures thereof, red, blue, brown, green, magenta, cyan, yellow, or mixtures thereof.

* * * * *